US006446342B1

(12) United States Patent
Chang

(10) Patent No.: US 6,446,342 B1
(45) Date of Patent: Sep. 10, 2002

(54) MULTI-FUNCTION CUTTER

(76) Inventor: Gin-Sung Chang, No. 15, Lane 385, Kuang-Ming Rd., Wu-Jih Hsiang, Taichung Hsien (TW)

( * ) Notice: Subject to any disclaimer, the term of this patent is extended or adjusted under 35 U.S.C. 154(b) by 0 days.

(21) Appl. No.: 09/944,719

(22) Filed: Aug. 31, 2001

(51) Int. Cl.[7] ..... B26B 1/08; B26B 11/00
(52) U.S. Cl. ..... 30/143; 30/123; 30/162
(58) Field of Search ..... 30/142, 143, 162, 30/123; 362/119, 120; 7/118, 158

(56) References Cited

U.S. PATENT DOCUMENTS 4,522,584 A * 6/1985 Crespy ..... 30/459
5,402,575 A * 4/1995 Maxcy ..... 30/123
5,727,319 A * 3/1998 Myerchin et al. ..... 30/123
6,044,560 A * 4/2000 Chao ..... 30/123

* cited by examiner

*Primary Examiner*—Hwei-Siu Payer
(74) *Attorney, Agent, or Firm*—Merchant & Gould P.C.

(57) ABSTRACT

A multi-function cutter includes an elongated casing, which has a rear end with an air inlet, and an intermediate portion with an air chamber and an air outlet. Air can be blown into the inlet so as to flow into and exit from the outlet via the chamber, thereby permitting generation of a whistling sound output. An indication lamp is disposed fixedly within a lamp opening in the front end of the casing. A lamp-switching member is movable within a first slide slot in the casing between an ON-position, where the lamp is turned on, and an OFF-position, where the lamp is turned off. A pusher is movable within a second slide slot in the casing so as to move a blade within the casing between an extended position and a retracted position.

7 Claims, 9 Drawing Sheets

MULTI-FUNCTION CUTTER

BACKGROUND OF THE INVENTION

1. Field of the Invention

This invention relates to a cutter, more particularly to one having multiple functions.

2. Description of the Related Art

To increase the functionality of a conventional cutter, it has been proposed heretofore to incorporate an indication lamp or a whistle thereto. It is desirable to provide a cutter that incorporates the functions of both an indication lamp and a whistle.

SUMMARY OF THE INVENTION

The object of this invention is to provide a multi-function cutter that incorporates the functions of an indication lamp and a whistle.

According to this invention, a multi-function cutter includes an elongated casing, which has a rear end with an air inlet, and an intermediate portion with an air chamber and an air outlet. Air can be blown into the inlet so as to flow into and exit from the outlet via the chamber, thereby permitting generation of a whistling sound output. An indication lamp is disposed fixedly within a lamp opening in the front end of the casing. A lamp-switching member is movable within a first slide slot in the casing between an ON-position, where the lamp is turned on, and an OFF-position, where the lamp is turned off. A pusher is movable within a second slide slot in the casing so as to move a blade within the casing between an extended position and a retracted position.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
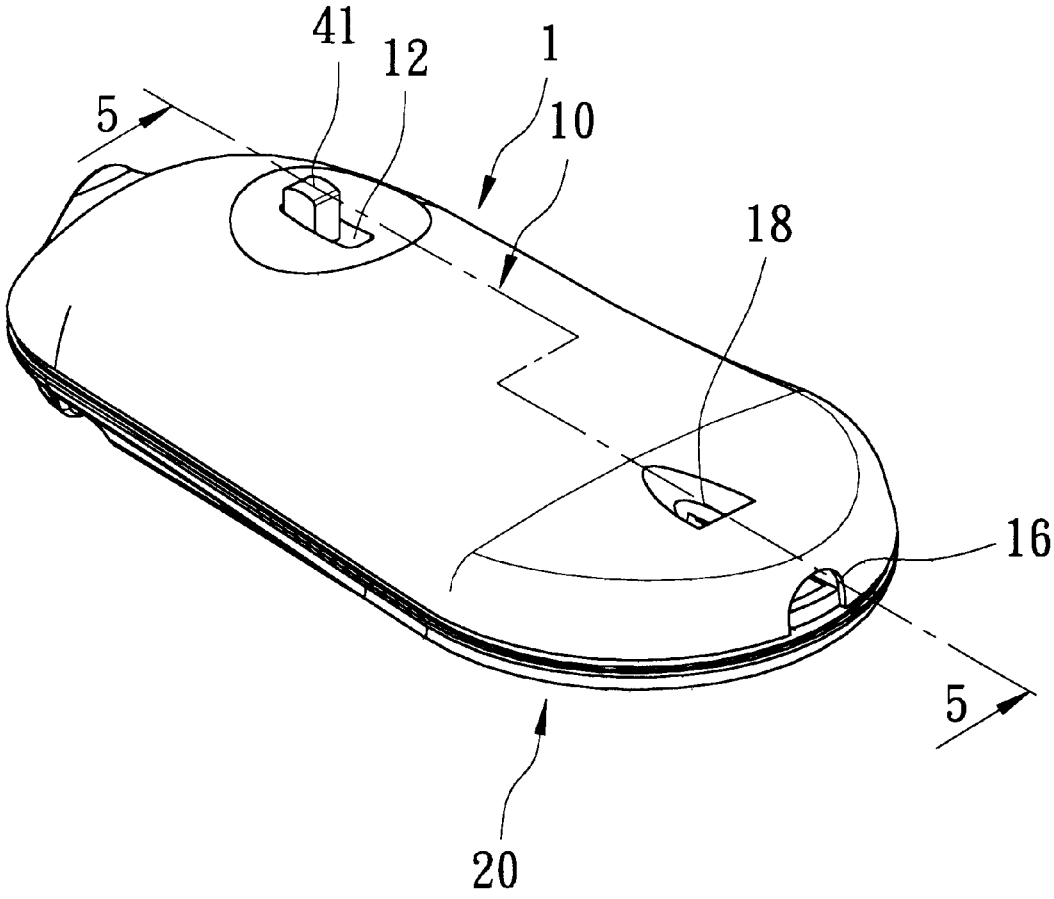
FIG. 1 is an assembled perspective view of the preferred embodiment of a multi-function cutter according to this invention.

Referring to FIGS. 1, 2, 3, 4 and 5, the preferred embodiment of a multi-function cutter 1 according to this invention is shown to include a casing consisting of a pair of first and second casing halves 10, 20, four bolts 30, a lamp-switching member 40, a battery unit consisting of two superposed batteries 50, an indication lamp 60, a positioning plate 70, a blade 80, a torsion spring 90 and a pusher 100. The bolts 30 extend through four holes 21 (see FIG. 2) in the second casing half 20, and engage four threaded holes 11 in the first casing half 10, thereby interconnecting the first and second casing halves 10, 20.

Figure 5:
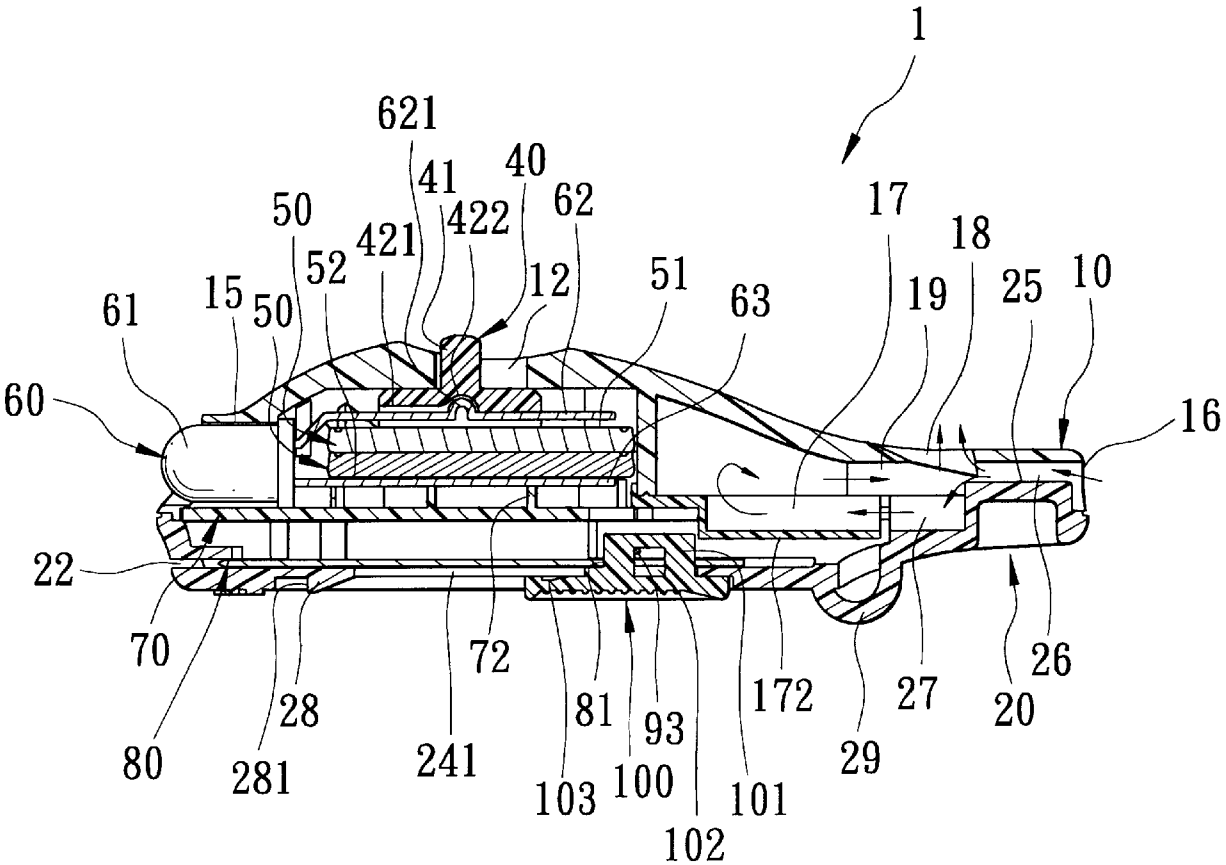
FIG. 5 is a sectional view of the preferred embodiment, taken along Line 5—5 in FIG. 1, when a lamp-switching member is disposed at an OFF-position and when a blade is disposed at a retracted position.
Figure 6:
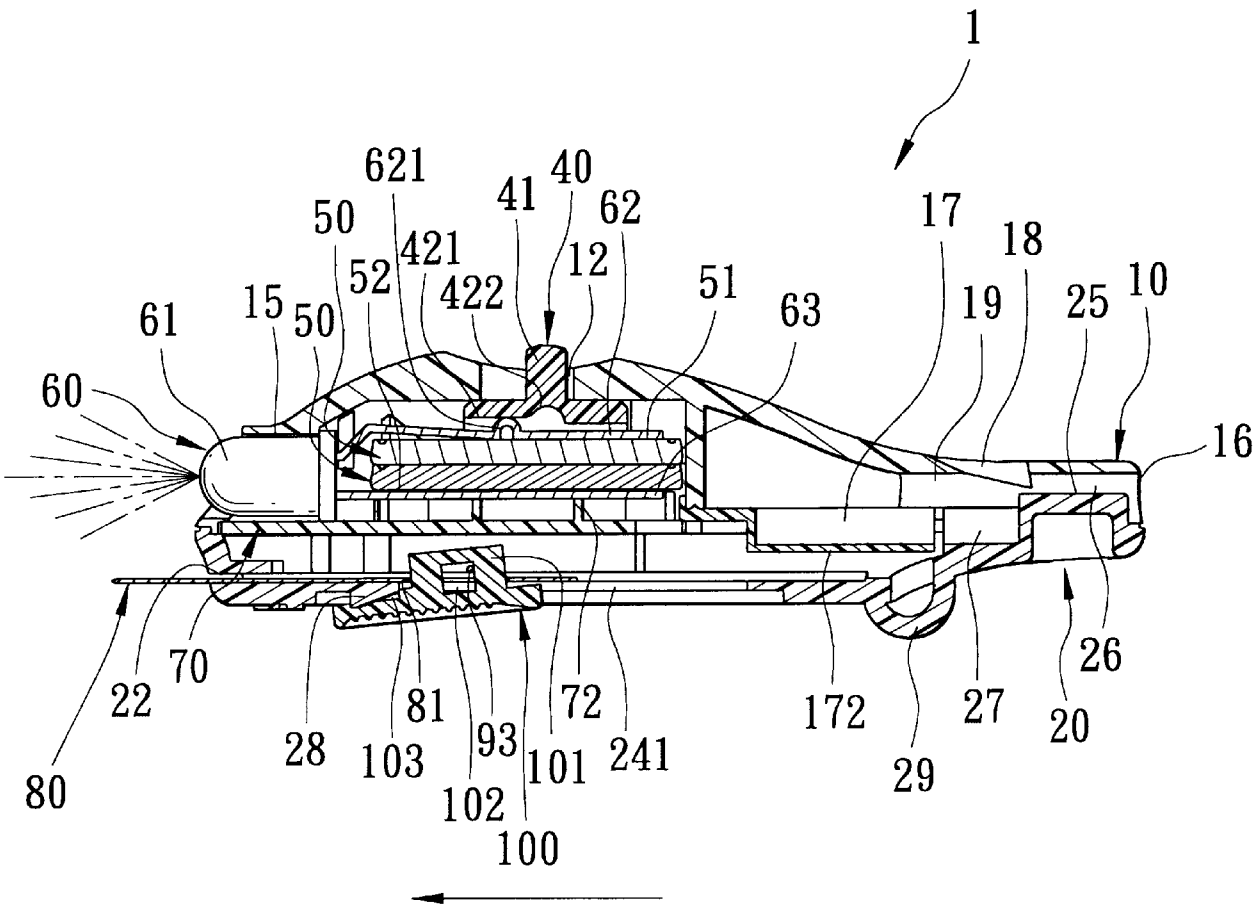
FIG. 6 is a sectional view of the preferred embodiment when the lamp-switching member is disposed at an ON-position and when the blade is disposed at an extended position.

The first casing half 10 is formed with a first slide slot 12, within which a stub 41 of the lamp-switching member 40 is movable between an OFF-position shown in FIG. 5 and an ON-position shown in FIG. 6. Two parallel straight guiding ribs 13 are formed on an inner surface of the first casing half 10 so as to confine a pressing plate 42 of the lamp-switching member 40 therebetween, thereby guiding the lamp-switching member 40 to move in a longitudinal direction of the first slide slot 12. The inner surface of the first casing half 10 further has two curved integral positioning plates 14 so as to confine the batteries 50 therebetween. A lamp opening 15 (see FIG. 3) is formed in a front end of the first casing half 10 for mounting a lamp body 61 of the lamp 60 fixedly therein. The first casing half 10 has a rear end, which is formed with an air inlet 16, and an intermediate portion that is formed with an air chamber 17, an air outlet 18 and a generally semicircular-cross-sectioned groove 19 that is formed in the inner surface of the first casing half 10 and that is in fluid communication with the inlet 16 and the air chamber 17. The air chamber 17 is shaped as a blind hole, which is defined between the inner surface of the first casing half 10 and a chamber-defining member 172 that are interconnected by known high frequency bonding techniques.

The second casing half 20 has a front end with a blade opening 22, and an inner surface with a plurality of spaced-apart surrounding walls 23 that cooperatively constitute a blade-receiving groove unit 24 for movement of the blade 80 therein.

As best shown in FIG. 5, the inner surface of the rear end of the second casing half 20 is formed with a projection 25 so as to define a narrow air passage 26 between the projection 25 and the first casing half 10, which has a rear end that is in fluid communication with the inlet 16. A wide air passage 27 is defined between the first and second casing halves 10, 20, is wider than the narrow air passage 26, and has a front end that is in fluid communication with an inlet 171 (see FIG. 3) of the air chamber 17, and a rear end that is in fluid communication with a front end of the narrow air passage 26. As such, air can be blown into the inlet 16 so as to exit from the outlet 18 along a flow path of the narrow and wide air passages 26, 27 and the air chamber 17, thereby permitting generation of a whistling sound output.

Figure 7:
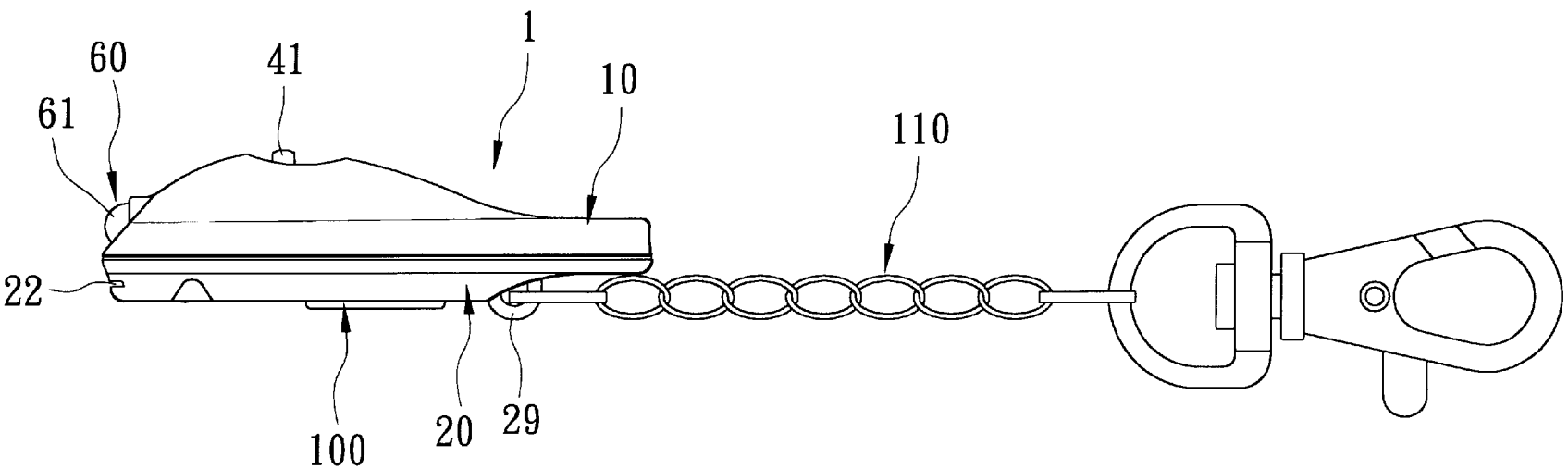
FIG. 7 is an assembled perspective view of the preferred embodiment, illustrating how a key chain is attached to a casing.

The second casing half 20 further includes a second slide slot 241 formed therethrough, within which the pusher 100 is received slidably. A wedge-shaped projection 28 is formed on an outer surface of the second casing half 20, and is disposed in front of and adjacent to a front end of the second slide slot 241. A ring 29 is formed integrally with the outer surface of the second casing half 20 so that a key chain 110 (see FIG. 7) can be fastened thereto.

Figure 9:
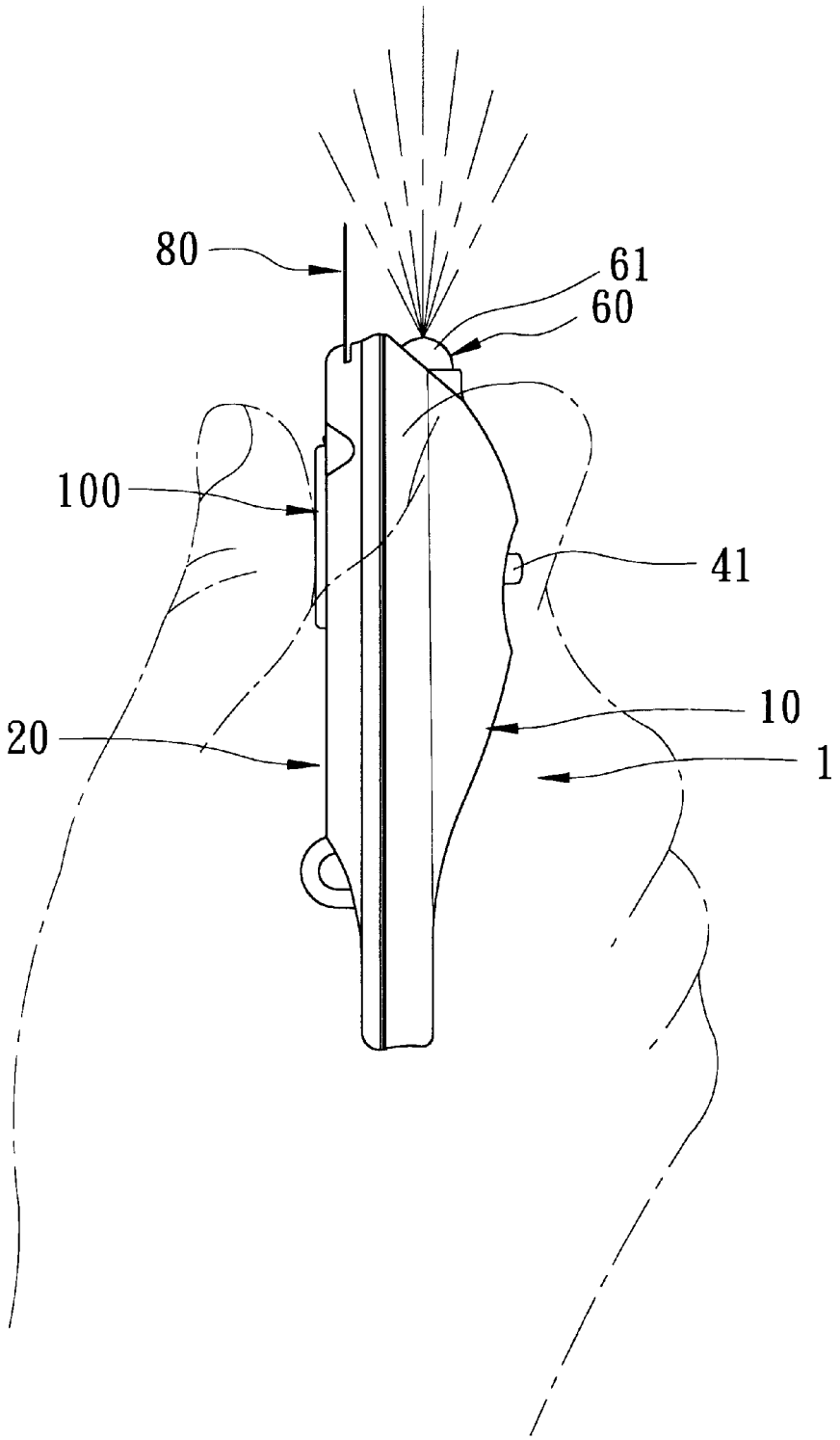
FIG. 9 is a schematic view of the preferred embodiment, illustrating how a pusher is pushed by one thumb of the user and how light is emitted from an indication lamp.

Referring again to FIGS. 1, 2, 3, 4 and 5, the pressing plate 42 of the lamp-switching member 40 has a pressing surface, which is formed with an open-ended slot 421 that increases forwardly and gradually in depth and that is defined by a bottom wall. The bottom wall has a middle portion that is formed with a cavity 422. A movable contact leg 62 of the lamp 60 extends through the open-ended slot 421 in the lamp-switching member 40, is in electrical connection with the lamp body 61, and is formed with an arched portion 621. The positioning plate 70 includes a plate body 71 that is disposed between the first and second casing halves 10, 20, a rib unit 72 that projects integrally from the plate body 71, and two holes 73 that are formed through the plate body 71. Two of the bolts 30 extend through the holes 73, respectively, so as to position the positioning plate 70 between the first and second casing halves 10, 20. The battery unit has a first side surface 51 (see FIG. 2) and a second side surface 52. The rib unit 72 of the positioning plate 70 presses the fixed contact leg 63 of the lamp 60 against the second side surface 52 of the battery unit so as to establish an electrical connection between the fixed contact leg 63 and the battery unit. When the lamp-switching member 40 is disposed at the OFF-position shown in FIG. 5, the arched portion 621 of the movable contact leg 62 engages the cavity 422 in the lamp-switching member 40 so that a free end of the movable contact leg 62 is spaced apart from the batteries 50, thereby breaking electrical connection between the movable contact leg 62 and the battery unit. When the lamp-switching member 40 is disposed at the ON-position shown in FIG. 6, the arched portion 621 of the movable contact leg 62 is moved from the cavity 422 to a front end portion of the open-ended slot 421 in front of the cavity 422 so that the pressing plate 42 presses against the arched portion 621 such that the free end of the movable contact leg 62 contacts one of the batteries 50, thereby establishing electrical connection between the movable contact leg 62 and the battery unit. As such, light will be emitted forwardly from the lamp body 61, as shown in FIG. 9.

Figure 2:
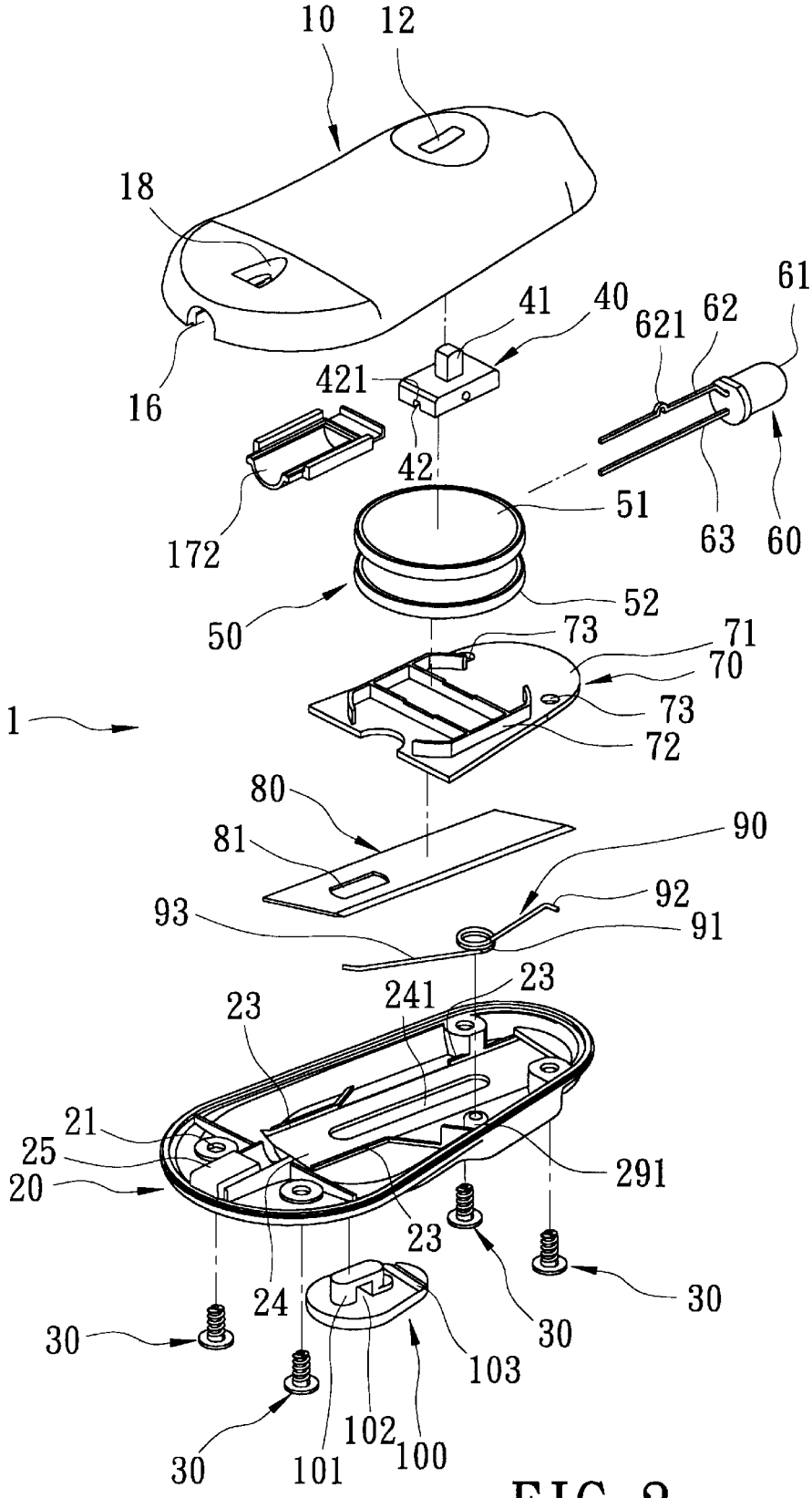
FIG. 2 is an exploded perspective view of the preferred embodiment.
Figure 3:
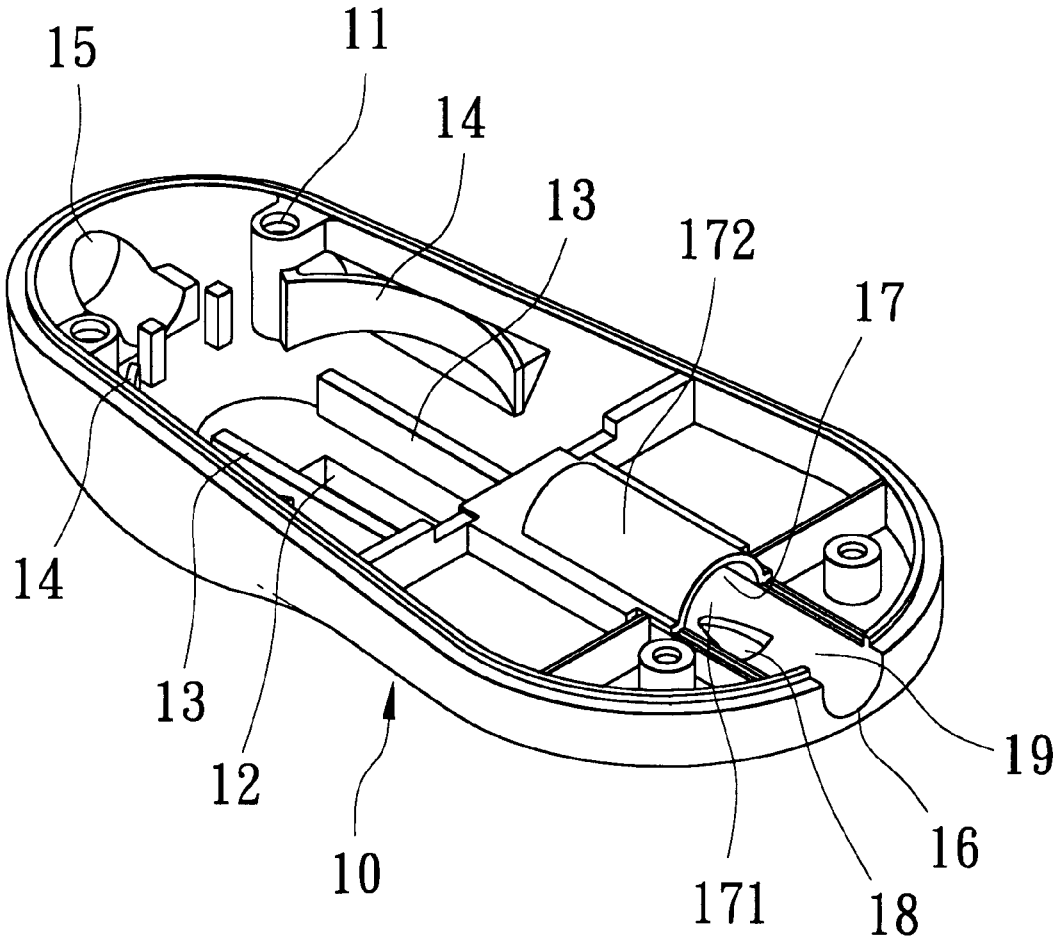
FIG. 3 is a perspective view of a first casing half of the preferred embodiment.
Figure 4:
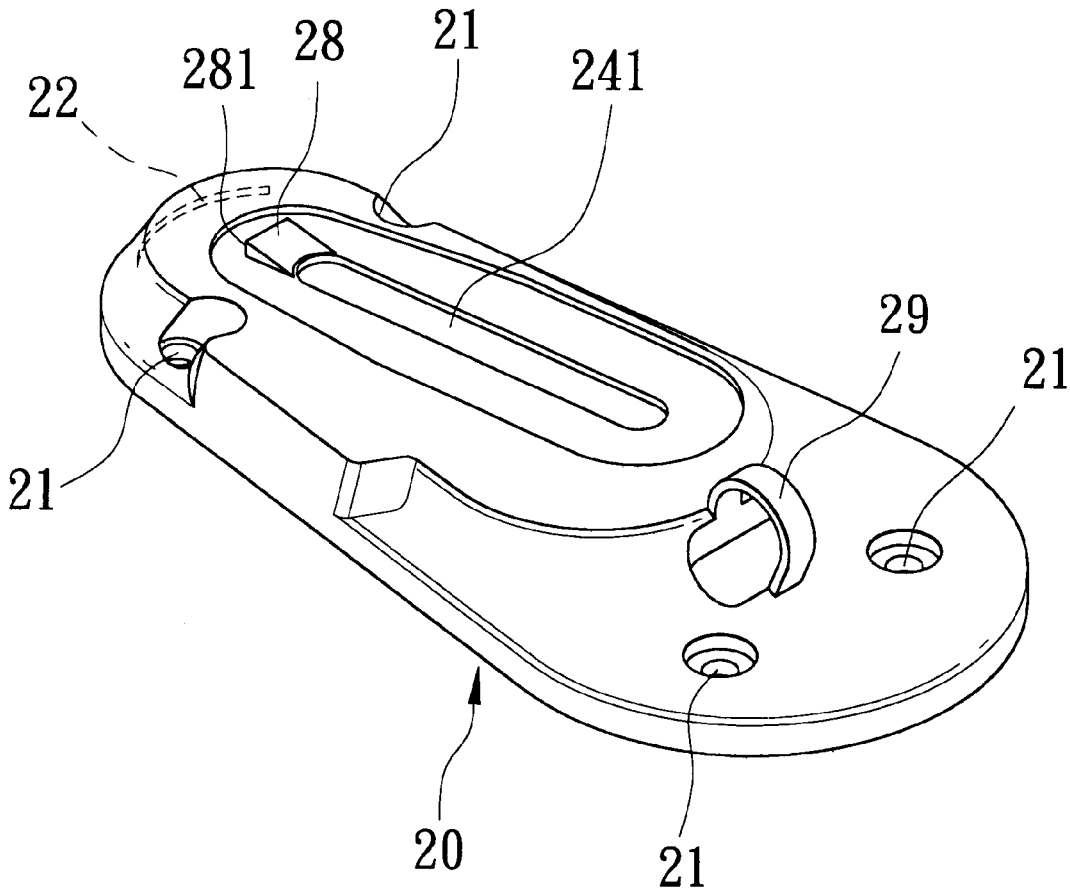
FIG. 4 is a perspective view of a second casing half of the preferred embodiment.
Figure 8:
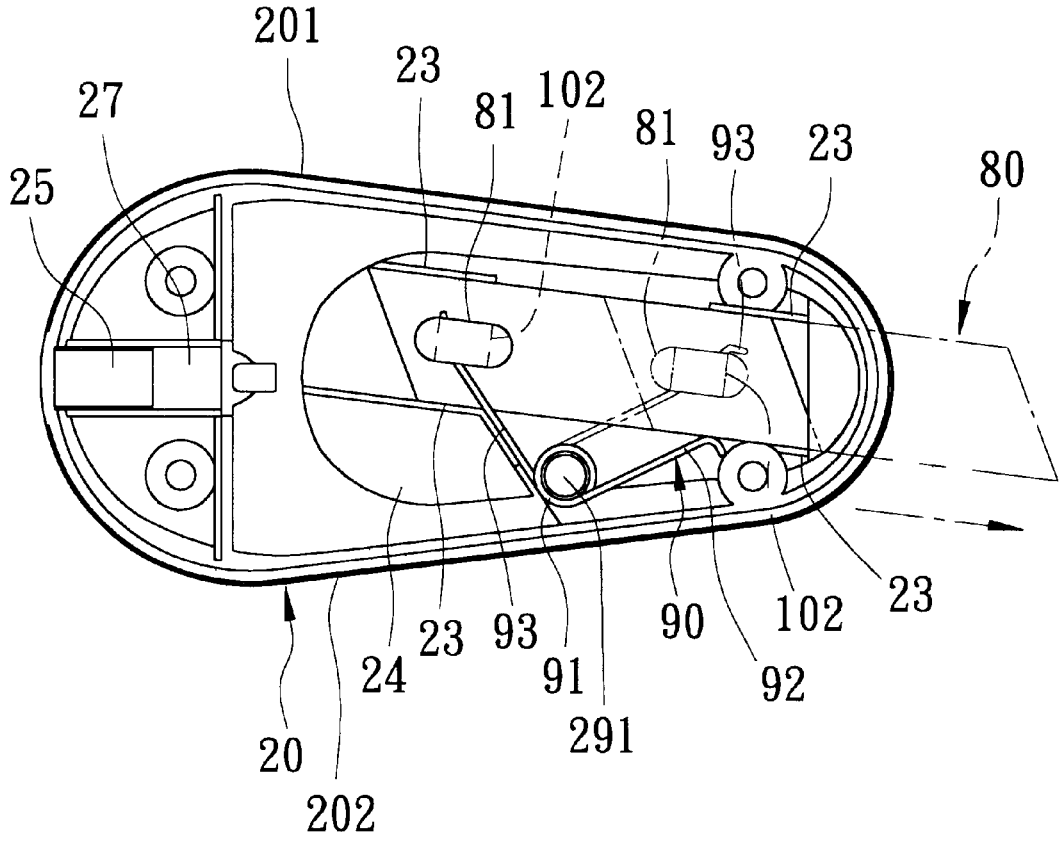
FIG. 8 is a schematic view of the preferred embodiment, illustrating how the blade is moved from the retracted position to the extended position in a direction that is parallel to one straight side of the casing.

Referring to FIGS. 2, 5 and 8, the pusher 100 has an integral tongue 101 that extends through a hole 81 in the blade 80. The torsion spring 90 has a coiled portion 91 that is sleeved on a positioning post 291 on the inner surface of the second casing half 20, a first pressing arm 92 that abuts against one of the surrounding walls 23, and a second pressing arm 93 that extends through a hole 102 in the tongue 101 so as to bias the blade 80 to a retracted position shown in FIG. 5.

Referring to FIG. 5, when the pusher 100 is moved to a rear end of the second slide slot 241 in the second casing half 20, the blade 80 is disposed at a retracted position, where the blade 80 is concealed between the first and second casing halves 10, 20.

Referring to FIG. 6, when the pusher 100 is moved to a front end of the second slide slot 241 in the second casing half 20, the blade 80 is disposed at the extended position, where the blade 80 projects partially and forwardly from the blade opening 22 and where a positioning slot 103 of the pusher 100 engages fittingly a front end portion 281 of the wedge-shaped projection 28, which has a front side surface that is perpendicular to the blade 80, thereby positioning the blade 80 relative to the second casing half 20. When the pusher 100 is actuated so as to disengage the positioning slot 103 from the wedge-shaped projection 28, the torsion spring 90 biases the blade 80 back to the retracted position.

Referring to FIG. 8, and the second casing half 20 has two opposite straight sides 201, 202 that form an angle therebetween, the blade 80 moves within the casing in a direction that is parallel to the side 201. As such, the pusher 100 can be operated easily by one thumb of the user, as shown in FIG. 9.

With this invention thus explained, it is apparent that numerous modifications and variations can be made without departing from the scope and spirit of this invention. It is therefore intended that this invention be limited only as indicated by the appended claims.

I claim:

1. A multi-function cutter comprising:

an elongated casing including an elongated first casing half with a first slide slot formed therethrough; and an elongated second casing half connected removably to said first casing half and formed with a second slide slot therethrough, said casing having a front end with a blade opening and a lamp opening, a rear end with an air inlet, and an intermediate portion with an air chamber defined between said first and second casing halves and an air outlet formed through one of said first and second casing halves, said air chamber being in fluid communication with said air inlet and said air outlet so as to be adapted to permit air flow from said air inlet to said air outlet via said air chamber, thereby permitting generation of a whistling sound output;

a lamp-switching member disposed slidably within said first slide slot in said first casing half and movable between an ON-position and an OFF-position;

a battery unit disposed fixedly in said casing and disposed adjacent to said lamp-switching member;

an indication lamp including a lamp body that is disposed fixedly within said lamp opening in said casing, a fixed contact leg in electrical connection with both said lamp body and said battery unit, and a movable contact leg in electrical connection with said lamp body and movable between a connecting position, where said lamp-switching member is disposed at said ON-position so that lamp-switching member presses said movable contact leg against said battery unit, thereby turning on said lamp body, and a disconnecting position, where said lamp-switching member is disposed at said OFF-POSITION so that said movable contact leg is released from said lamp-switching member, thereby turning off said lamp body;

a blade disposed slidably within said casing and movable between an extended position, where said blade projects forwardly and partially from said blade opening, and a retracted position, where said blade is concealed within said casing; and a pusher connected fixedly to said blade and disposed slidably within said second slide slot in said second casing half.

2. The multi-function cutter as claimed in claim 1, further comprising:

a positioning unit for positioning said blade at said extended position; and a spring disposed in said casing so as to bias said blade to said retracted position.

3. The multi-function cutter as claimed in claim 2, wherein said second casing half further includes a wedge-shaped integral projection, which is disposed in front of said second slide slot, which increases forwardly and gradually in thickness, and which has a front side surface that is perpendicular to said blade, said pusher being formed with a positioning slot that has a wedge-shaped cross-section and that engages fittingly a front end portion of said projection when said blade is disposed at said extended position, thereby positioning said blade on said second casing half, said projection and said positioning slot cooperatively constituting said positioning unit.

4. The multi-function cutter as claimed in claim 1, wherein said casing further includes:

a narrow air passage formed in said casing and located in front of said air inlet;

a wide air passage formed in said casing and located in front of said narrow air passage, said wide air passage being wider than said narrow air passage;

a blind hole defined in said first casing half so as to constitute said air chamber, and having a closed front end and an open rear end that is disposed in front of said wide air passage, said air outlet being located between said rear end of said blind hole and said air inlet, thereby permitting flow of the air from said air inlet to said air outlet via said narrow and wide air passages and said air chamber.

5. The multi-function cutter as claimed in claim 1, wherein said battery unit includes two superposed batteries, each of which is shaped as a circular plate, said first casing half having an inner surface, which is formed integrally with two parallel straight guiding ribs that are located on two sides of said first slide slot and that confine said lamp-switching member between said straight guiding ribs, and two curved positioning plates that are fixed on said inner surface of said first casing half and that confine said battery unit between said positioning plates.

6. The multi-function cutter as claimed in claim 5, further comprising a positioning plate, which is fixed in said casing and which has a side surface that is formed with two parallel pressing ribs, said battery unit having a first side surface and a second side surface that are opposite to each other, said pressing ribs pressing said fixed contact leg against said second side surface, said lamp-switching member having a pressing surface, which is formed with an open-ended slot that increases forwardly and gradually in depth and that is defined by a bottom wall, said bottom wall having an intermediate portion with a cavity, said movable contact leg of said lamp extending through said open-ended slot and having an arched portion that engages said cavity when said lamp-switching member is disposed at said OFF-position, and that is disposed within a front end portion of said open-ended slot in front of said cavity so that said lamp-switching member presses against said arched portion of said movable contact leg, thereby pressing said movable contact leg against said first side surface of said battery unit when said lamp-switching member is disposed at said ON-position.

7. The multi-function cutter as claimed in claim 1, further comprising a key chain that is fastened to one of said first and second casing halves.

* * * * *